US009615701B2

(12) United States Patent
Shen

(10) Patent No.: US 9,615,701 B2
(45) Date of Patent: Apr. 11, 2017

(54) SHOWER HEAD HAVING ELECTRICALLY DRIVEN CLEANING DEVICE

(71) Applicant: MING YIH PRECISION CO., LTD., Taoyuan Hsien (TW)

(72) Inventor: Yung-Chuan Shen, Taoyuan Hsien (TW)

(73) Assignee: Ming Yih Precision Co., Ltd., Taoyuan Hsien (TW)

( * ) Notice: Subject to any disclaimer, the term of this patent is extended or adjusted under 35 U.S.C. 154(b) by 705 days.

(21) Appl. No.: 14/040,910

(22) Filed: Sep. 30, 2013

(65) Prior Publication Data

US 2014/0196229 A1 Jul. 17, 2014

(30) Foreign Application Priority Data

Jan. 14, 2013 (TW) ..... 102200787 U

(51) Int. Cl.

| | |
|---|---|
| ***A46B 13/04*** | (2006.01) |
| ***A47K 7/04*** | (2006.01) |
| ***B05B 1/18*** | (2006.01) |
| ***B05B 7/24*** | (2006.01) |
| ***A46B 11/00*** | (2006.01) |
| ***A46B 11/06*** | (2006.01) |
| ***A46B 13/02*** | (2006.01) |
| *A46B 13/00* | (2006.01) |

(52) U.S. Cl.

CPC ..... *A47K 7/04* (2013.01); *A46B 11/0055* (2013.01); *A46B 11/06* (2013.01); *A46B 13/02* (2013.01); *A46B 13/04* (2013.01); *A47K 7/043* (2013.01); *B05B 1/18* (2013.01); *B05B 7/2464* (2013.01); *A46B 13/008* (2013.01)

(58) Field of Classification Search

CPC ..... A46B 13/04; A46B 2200/1006; A46B 13/008; A47K 7/043

See application file for complete search history.

(56) References Cited

U.S. PATENT DOCUMENTS

| | | | | | |
|---|---|---|---|---|---|
| 1,604,500 | A * | 10/1926 | Tannenbaum | A46B 13/04 | 15/29 |
| 1,630,084 | A * | 5/1927 | Holtzman | A46B 13/04 | 15/188 |
| 2,744,271 | A * | 5/1956 | Florence | A46B 13/04 | 137/893 |
| 3,293,678 | A * | 12/1966 | South | A47L 1/05 | 15/29 |
| 3,638,264 | A * | 2/1972 | Walton | A46B 13/04 | 15/29 |
| 3,864,780 | A * | 2/1975 | Watkins | A46B 13/06 | 15/29 |
| 3,968,789 | A * | 7/1976 | Simoncini | A46B 13/04 | 15/22.1 |

(Continued)

*Primary Examiner* — Randall Chin

(74) *Attorney, Agent, or Firm* — Rosenberg, Klein & Lee

(57) ABSTRACT

A shower head includes a main body, a motor, a cleaning device and a liquid dispenser. The main body has a channel, an inlet and a plurality of outlets. The channel fluidly connects the inlet and the plurality of outlets. The motor is disposed in the main body and has a driving shaft. The cleaning device is connected to the shaft of the motor. The cleaning device has a cleaning portion exposed on the main body. The liquid dispenser is disposed in the main body and has an outlet terminal in fluid connection with the cleaning portion.

17 Claims, 12 Drawing Sheets

(56) References Cited

U.S. PATENT DOCUMENTS

| | | | | | |
|---|---|---|---|---|---|
| 4,089,079 | A * | 5/1978 | Nicholson | A46B 13/06 | 15/29 |
| 4,796,321 | A * | 1/1989 | Lee | A46B 13/04 | 15/29 |
| 5,701,625 | A * | 12/1997 | Siman | A46B 13/02 | 15/21.1 |
| 8,308,390 | B2 * | 11/2012 | Kao | A46B 11/0062 | 401/289 |

* cited by examiner

SHOWER HEAD HAVING ELECTRICALLY DRIVEN CLEANING DEVICE

BACKGROUND

1. Field of the Invention

The instant disclosure relates to a shower head having a cleaning device.

2. Description of Related Art

Sanitary equipment has advanced from a bath tub to a shower kit, for example, shower head. The amount of water consumed by a shower head is much less than filling a bath tub, and a shower head provides more flexibility in handling. However, when a shower head is used, it is not uncommon to use a brush, sponge or scrub sponge at the same time to facilitate the clean-up.

With one hand holding the shower head and the other a cleaning device, it is relatively inconvenient because a user will not have a spare hand to perform another task.

BRIEF SUMMARY OF THE INVENTION

The instant disclosure provides a shower head having a cleaning device and a sanitary system. The instant disclosure allows automatic brushing and liquid dispensing to be performed simultaneously for an easier and more convenient handling.

According to one exemplary embodiment of the instant disclosure, the shower head includes a main body, a motor, a cleaning device and a liquid dispenser. The main body has a channel, an inlet and a plurality of outlets. The channel fluidly connects the inlet and the plurality of outlets. The motor is disposed in the main body and has a driving shaft. The cleaning device is connected to the shaft of the motor. The cleaning device has a cleaning portion exposed on the main body. The liquid dispenser is disposed in the main body and has an outlet terminal in fluid connection with the cleaning portion.

In another embodiment of the instant disclosure, the sanitary system includes a shower head and an electrical boiler. The shower head includes a main body, a motor, a cleaning device and a liquid dispenser. The main body has a channel, an inlet and a plurality of outlets. The channel fluidly connects the inlet and the plurality of outlets. The motor is disposed in the main body and has a driving shaft. The cleaning device is connected to the shaft of the motor. The cleaning device has a cleaning portion exposed on the main body. The liquid dispenser is disposed in the main body. The electrical boiler includes a case, a heating tank, an inlet end, an outlet end and a circuit unit, wherein the inlet end and the outlet end are in fluid connection with the heating tank, the heating tank is enclosed by the case, the heating tank has an electrical heating component, the circuit unit is disposed inside the case, the electrical heating component is electrically connected to the circuit unit, the inlet is in fluid connection with an inlet hose which connects to the outlet end of the electrical boiler at the other end thereof.

The cleaning portion of the shower head can be used to clean any surface under contact and remove the dirt. Furthermore, the liquid dispenser attached to the shower head can supply washing detergent or showering gel to the cleaning portion. In short, the instant disclosure provides the shower head and sanitary system which are capable of electrically driven brushing and dispensing liquid.

In addition, the cleaning portion is detachably disposed on the seat, such that replacement can be easily done, and the hygiene of the cleaning portion can be achieved. A plate of the instant disclosure is formed with a plurality of passages such that the liquid can go through the passages to the bristles of the cleaning portion. The instant disclosure also includes a cable which is disposed in an independent cable channel. That is to say the cable channel and the water channel are separate, and the safety concern is attended. The outlet of the instant disclosure slants toward the centre region of the cleaning device such that the fluid concentrates toward the cleaning portion for an even stronger flow. The motor of the instant disclosure is disposed on the main body of the shower head by a motor seat which allows easy access to the motor.

In order to further understand the instant disclosure, the following embodiments are provided along with illustrations to facilitate the appreciation of the instant disclosure; however, the appended drawings are merely provided for reference and illustration, without any intention to be used for limiting the scope of the instant disclosure.

DETAILED DESCRIPTION OF THE INVENTION

Figure 1:
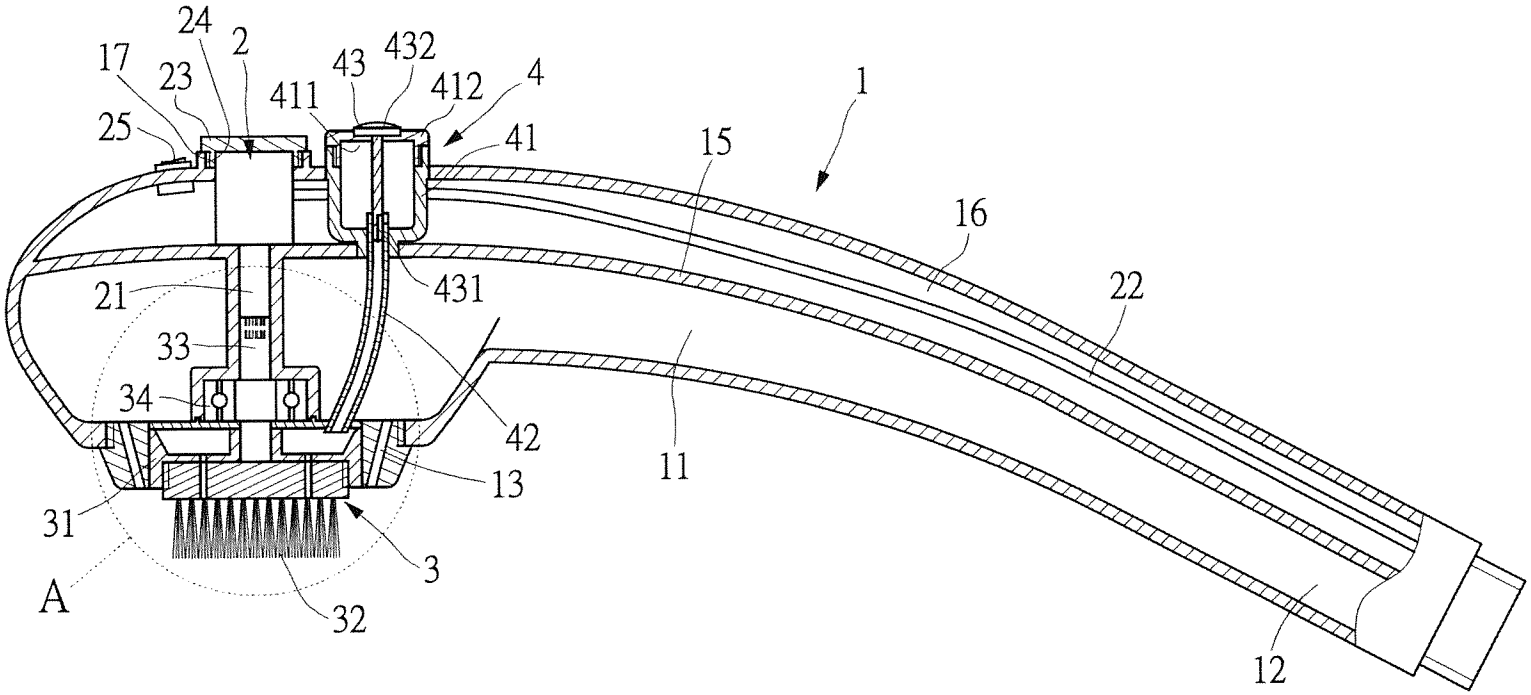
FIG. 1 is a cross-sectional view of a shower head in accordance with a first embodiment of the instant disclosure.
Figure 2:
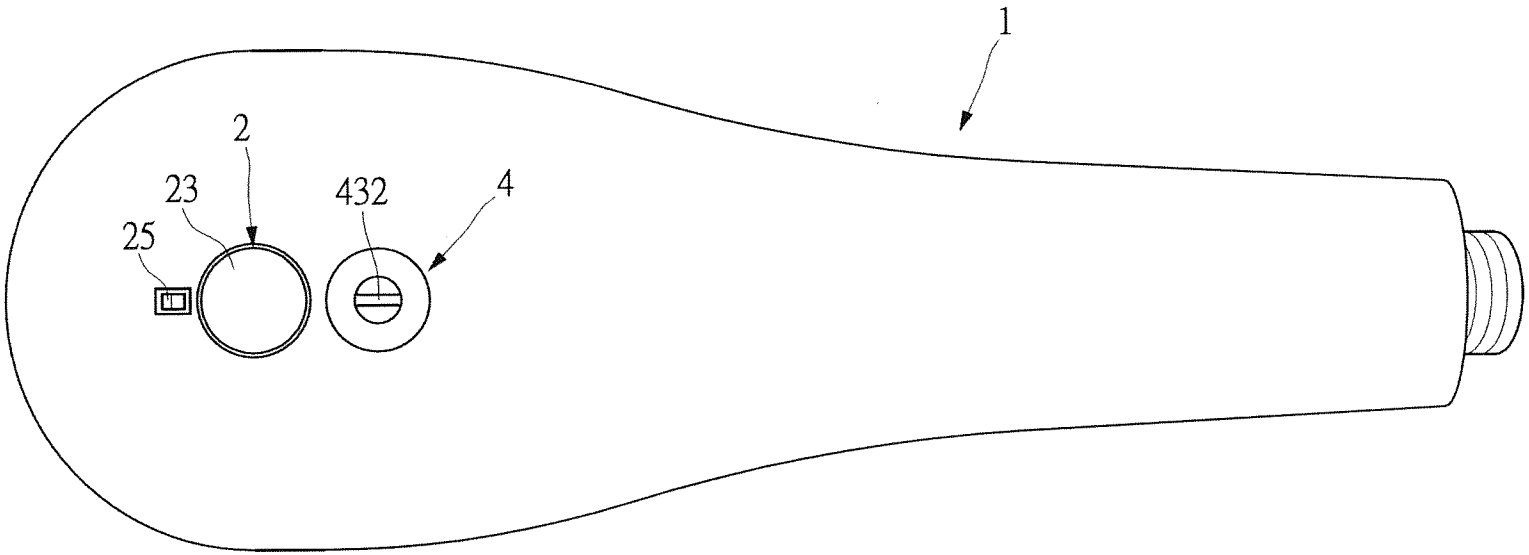
FIG. 2 is a cross-sectional view of a shower head in accordance with a first embodiment of the instant disclosure.
Figure 3:
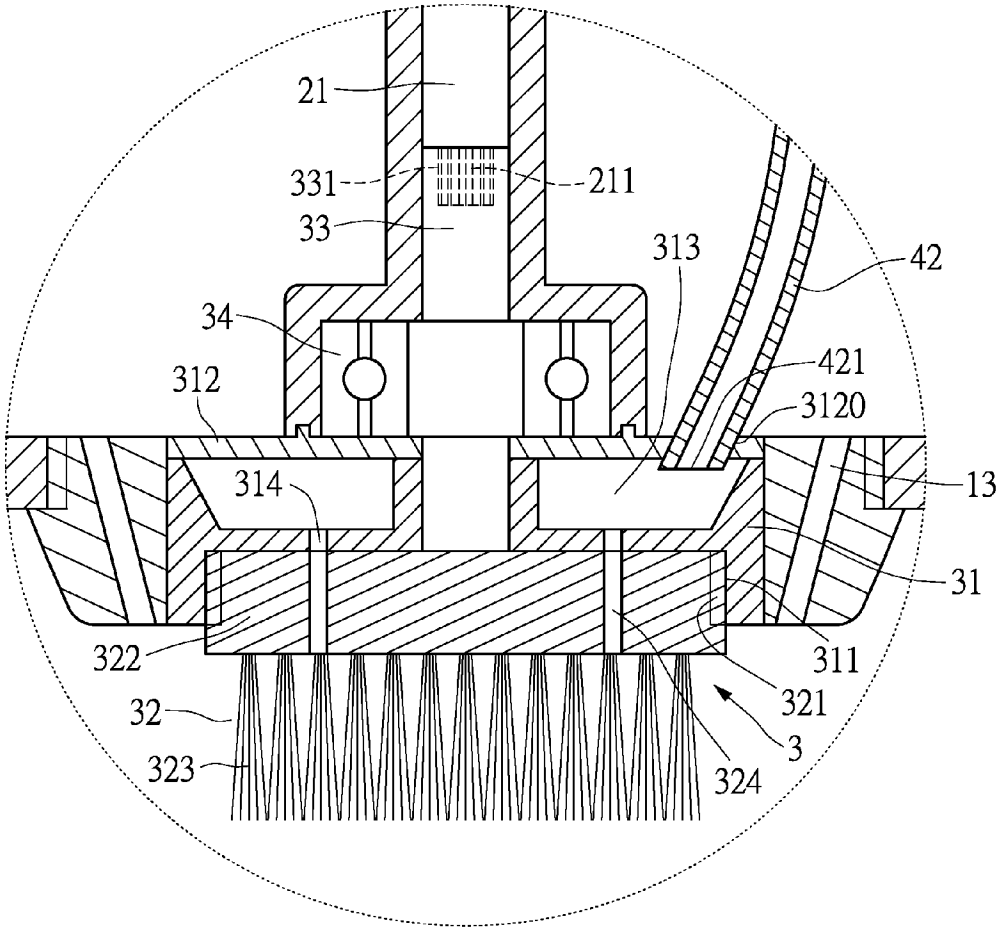
FIG. 3 is a partially enlarged view of portion A in FIG. 1.
Figure 4:
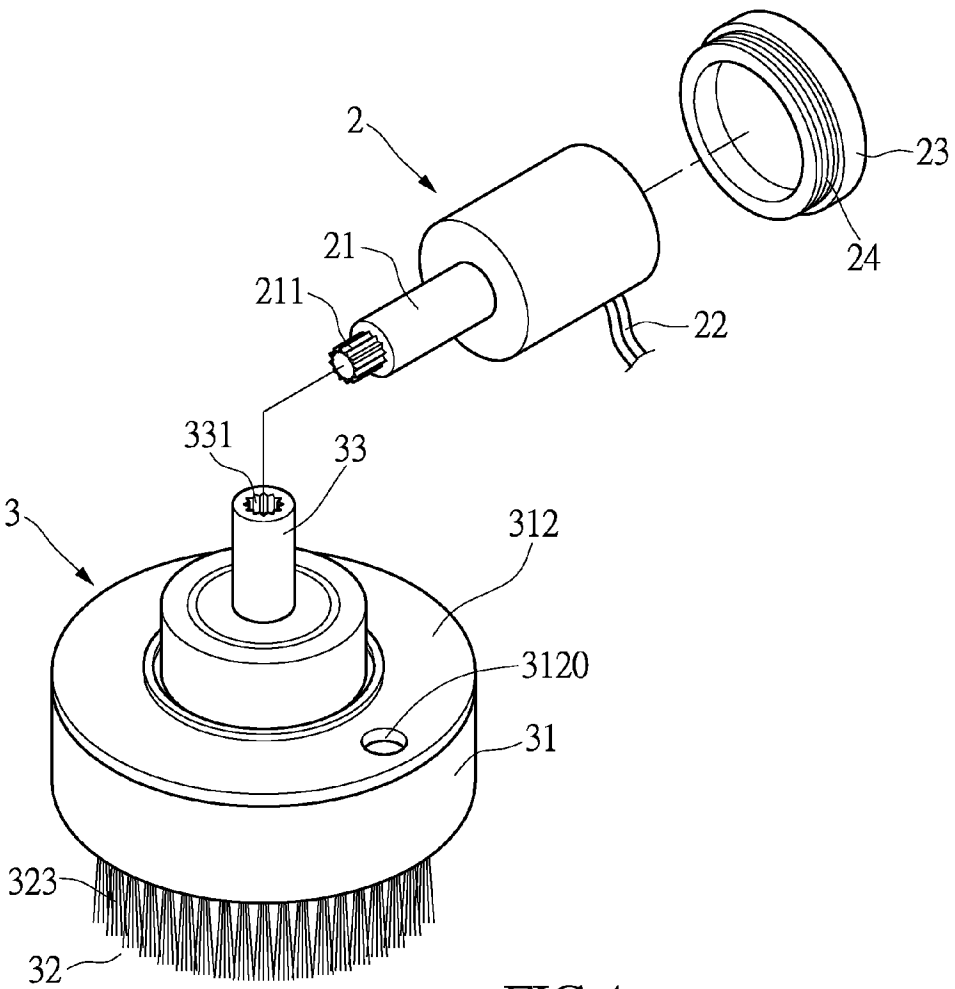
FIG. 4 is a partially exploded view of a shower head in accordance with a first embodiment of the instant disclosure.

The aforementioned illustrations and following detailed descriptions are exemplary for the purpose of further explaining the scope of the instant disclosure. Other objectives and advantages related to the instant disclosure will be illustrated in the subsequent descriptions and appended drawings.

Please refer to FIGS. 1 to 4. The instant disclosure provides a shower head having electrically driven cleaning device which includes a main body 1, a motor 2, a cleaning device 3 and a liquid dispenser 4.

The main body 1 is preferably made of plastic material but not limited thereto. The main body 1 is a hollow body and can be manufactured as one piece or jointed by different parts. The configuration of the main body 1 is not limited to the instant embodiment. The main body 1 may adapt a flexible body which allows length adjustment. The main body 1 is formed with a channel 11, an inlet 12 and a plurality of outlets 13. The channel 11 is buried within the main body 1. The inlet 12 and the plurality of outlets 13 are disposed at the opposite ends of the main body 1 yet in fluid connection via the channel 11. The inlet 12 and the outlets 13 may be through apertures, and a nozzle may be attached to the outlet 13 for desirable effect. The configuration of the outlet 13 is not limited to the instant embodiment.

Figure 5:
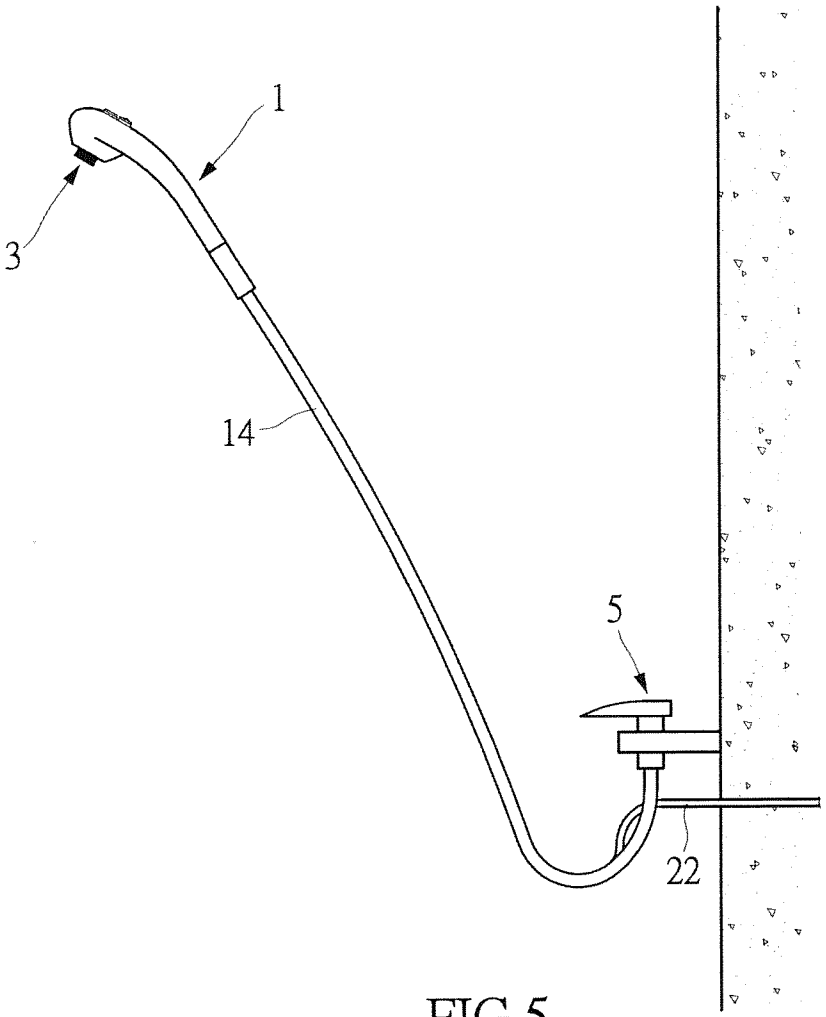
FIG. 5 is a perspective view of a shower head in accordance with a second embodiment of the instant disclosure.

The inlet 12 connects to a hose 14 (as shown in FIG. 5) which brings in the water. Following that, the water goes through the channel 11 to the outlet 13 and sprays liquid therefrom.

The motor 2 is an electric motor disposed in the main body 1. The motor is preferably disposed proximate to the outlet 13. The motor 2 has a driving shaft 21. When power is supplied to the motor 2, the driving shaft 21 is therefore driven to rotate. The motor 2 is electrically connected to a motor switch 25 which is disposed on the circumferential region of the main body 1. The motor switch 25 regulates the operation of the motor 2. The motor 2 is connected to suitable power which may be battery, rechargeable battery or any other conventional power sources. In the instant embodiment, the motor 2 is connected to a power cable 22, and the power is provided from the power cable 22. The main body 1 is divided to form a power cable channel 16 by a partition 15. The power cable 22 is received in the power cable channel 16 which is independent from the water channel 11. The separation of the water and power ensures the safety of the instant disclosure. The power may come from a water driven generator (not shown). Specifically, the generator is disposed in the channel 11 and the water goes through a turbine of the generator to generate electricity from mechanical energy. A water generator is conventional to a person skill in the art, and it is not elaborated herein to avoid repetition.

In the instant embodiment, the motor 2 is engaged with a motor seat 23. The motor seat 23 is formed with a threaded ring 24, and the main body 1 is formed with a threaded bore 17 for receiving the threaded ring 24. The threaded ring 24 and the threaded bore 17 mate, and the motor 2 is therefore secured within the main body 1. The engagement between the motor 2 and the main body 1 allows easier access upon assembly or during maintenance. The engagement between the motor 2 and the main body 1 is not limited to the instant embodiment, and its position may vary as well.

The cleaning device 3 is connected to the driving shaft 21 of the motor 2, and the motor 2 drives the cleaning device 3 to rotation. The cleaning device 3 has a cleaning portion 32 partially exposed on the main body 1 for direct contacting with a subject. The cleaning device 3 has a seat 31, the cleaning portion 32 and a shaft 33. In the instant embodiment, the cleaning portion 32 is a brush, yet it may be any types of sanitary device in another embodiment. The cleaning portion 32 is preferably detachably disposed on the seat 31 such that the cleaning portion 32 can be easily replaced if necessary.

The seat 31 is formed with a first threaded portion 311 while the cleaning portion 32 is formed with a second threaded portion 321. The first and second threaded portions 311, 321 conformingly mate each other upon assembly. The first threaded portion 311 may be the female, and the second threaded portion 321 should be the male, vise versa. The cleaning portion 32 can be disengaged from the seat 31. In addition, the cleaning portion 32 may be secured to the seat 31 by simple mating, attachment belt or magnets.

One end of the shaft 33 is fixed to the seat 31 while the other end of the shaft 33 is connected to the driving shaft 21 of the motor 2. The shaft 33 and the driving shaft 21 may be formed integrally or as separate elements. In the instant embodiment, the shaft 33 and the driving shaft 21 are separate elements. One end of the shaft 33 is formed with a bore 331 having teethed decoration. The corresponding end of the driving shaft 21 is formed with a conforming teethed pillar 211. The pillar 211 is received by the bore 331, and the driving shaft 21 is secured to the shaft 33 thereby. When the motor 2 is powered, the driving shaft 21 rotates. Subsequently, the cleaning device 3 rotates as well because of the connection between the shaft 33 and the driving shaft 21. Additionally, driving mechanism (not shown) having a gear set can be implemented between the driving shaft 21 of the motor 2 and the cleaning device 3 to perform similar mechanical movement.

A washer 34 is disposed between the shaft 33 of the cleaning device 3 and the main body 1. The washer 34 supports the seat 31 and cleaning portion 32 and confines the shaft 33. The cleaning portion 32 extends out of the main body 1 to an appropriate distance for being able to contact the subject. The outlets 13 are disposed along the circumferential portion of the cleaning portion 32 in predetermined intervals. Preferably, the outlets 13 slant toward the centre region of the cleaning device 3 to concentrate the water beams at the cleaning portion 32.

The liquid dispenser 4 is disposed in the main body to provide shower gel or other washing detergent to the cleaning portion 32 of the cleaning device 3. The liquid dispenser 4 includes a tank 41 and a duct 42. The tank 41 is disposed in the main body 1 and has portions defining an opening 411. Supplemental liquid is added to the tank 4 via the opening 411. A tank lid 412 is disposed over the opening 411 by thread mating or simple engagement.

One end of the duct 42 is connected to the tank 41 from, preferably, the downstream end of the tank 41. The other end of the duct 42 is formed with an outlet terminal 421. The outlet terminal 421 is disposed proximate to the cleaning portion 32 of the cleaning device 3, and the liquid in the tank 41 is delivered via the duct 42 to the cleaning portion 32.

In the instant embodiment, the seat 31 has portions defining a receiving space 313. The downstream end of the seat 31 is formed with at least one aperture 314, and the aperture 314 is in fluid connection with the receiving space 313. A lid 312 covers the seat 31 over the receiving space 313. The lid 312 may be engaged with the main body 1. The lid 312 provides an aperture 3120. The outlet terminal 421 of the duct 42 passes through the aperture 3120 and stretches into the receiving space 313 such that the liquid in the tank 41 can be received by the receiving space 313. The liquid then goes through the apertures 314 of the seat 3 to the cleaning portion 32.

The cleaning portion 32 may be brush, sponge, scrub sponge or the like. The upstream portion is defined as a plate 322 and the downstream portion is defined as bristles 323. The plate 322 has portions defining a plurality of passages 324 for guiding the liquid from the receiving space 313 to the bristles 323 of the cleaning portion 32. In this way, the liquid is more evenly distributed.

The liquid dispenser 4 may further include a liquid switch 43 for regulating the dispensing of the liquid to the cleaning portion 32 of the cleaning device 3. In the instant embodiment, a valve 431 is disposed at the downstream end of the tank 41. The valve 431 is connected to a twisting button 432. When the twisting button 432 is rotated, the valve 431 opens or closes the downstream end of the tank 41 such that the liquid in the tank 41 may enter the duct 42 to the cleaning portion 32. However, the configuration of the liquid switch 43 is not limited to the instant embodiment.

Because of the motor 2 and the cleaning device 3, the shower head becomes an electrically driven cleaning device for sanitary purpose. On top of the electrically driven brushing, the shower head also has the liquid dispenser supplying washing gel or detergent.

Figure 6:
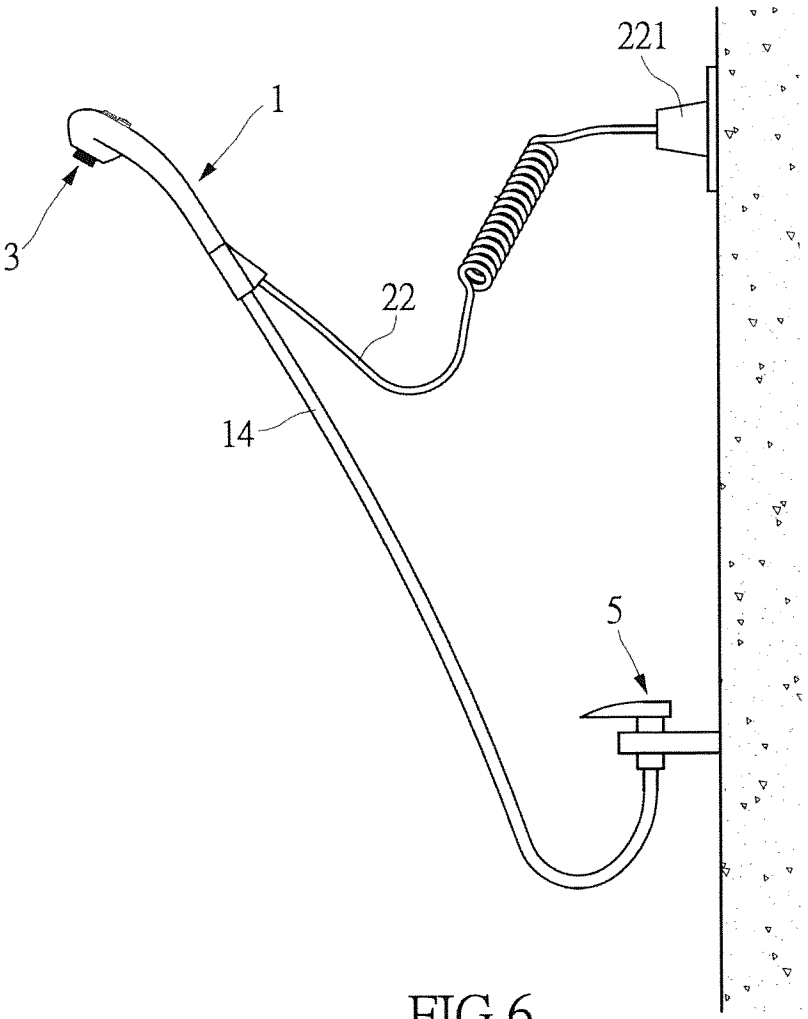
FIG. 6 is a perspective view of a shower head in accordance with a third embodiment of the instant disclosure.

Please refer to FIGS. 5 and 6. In the instant embodiment, one end of the hose 14 is connected to the inlet 12. (Please refer to FIG. 1.) The other end of the hose 14 is connected to a source of water 5 (e.g. a faucet) to deliver water to the main body 1. One end of the power cable 22 is connected to the motor 2 while the other end thereof is connected to a source of power via plugs 221. The hose 14 and the power cable 22 may form integrally (as shown in FIG. 5) or separately (as shown in FIG. 6). The power cable 22 may also be coiled to allow more room for length adjustment.

Figure 7:
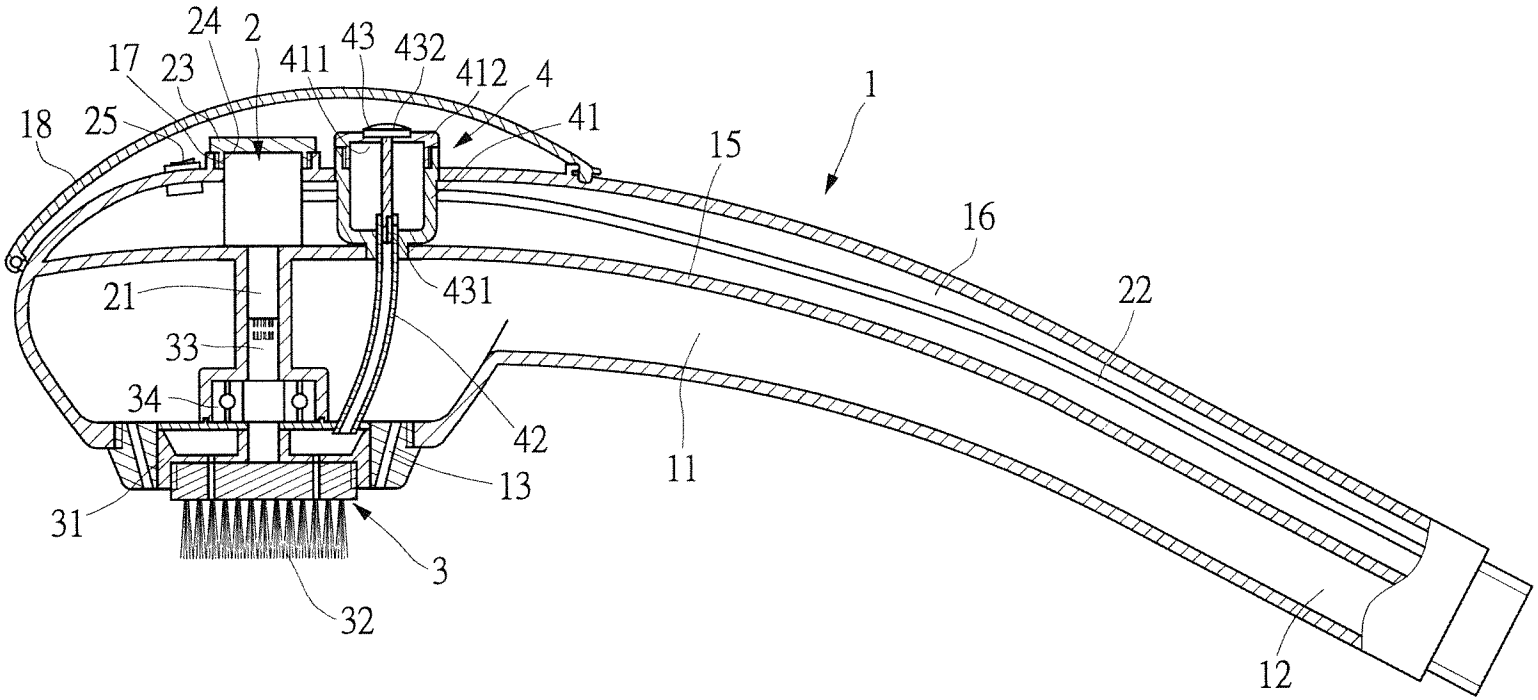
FIG. 7 is a cross-sectional view of a shower head in accordance with a fourth embodiment of the instant disclosure.

Please refer to FIG. 7. In the instant embodiment, a cover 18 is disposed on the main body 1. The cover 18 may hide any bulged portions of the motor 2 and the liquid dispenser 4 to improve aesthetic.

Figure 8:
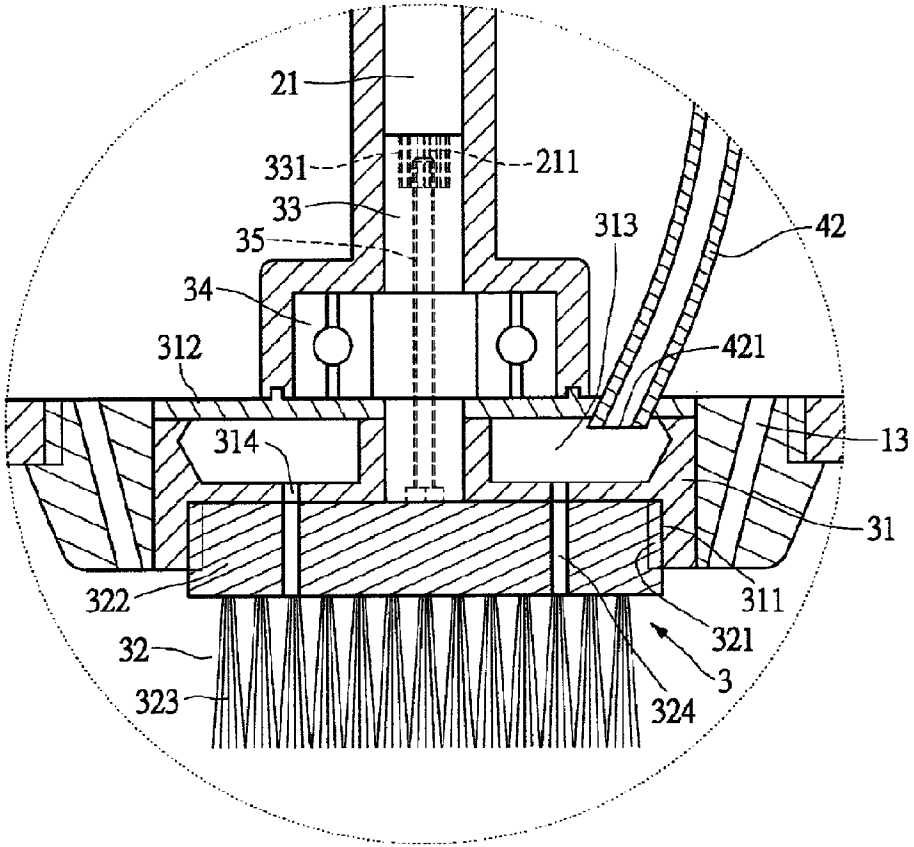
FIG. 8 is a partially enlarged view of a shower head in accordance with a fifth embodiment of the instant disclosure.

Please refer to FIG. 8. In the instant embodiment, the shaft 33 of the cleaning device 3 and the driving shaft 21 of the motor 2 are secured by a fastening element 35 (e.g. a screw).

Figure 9:
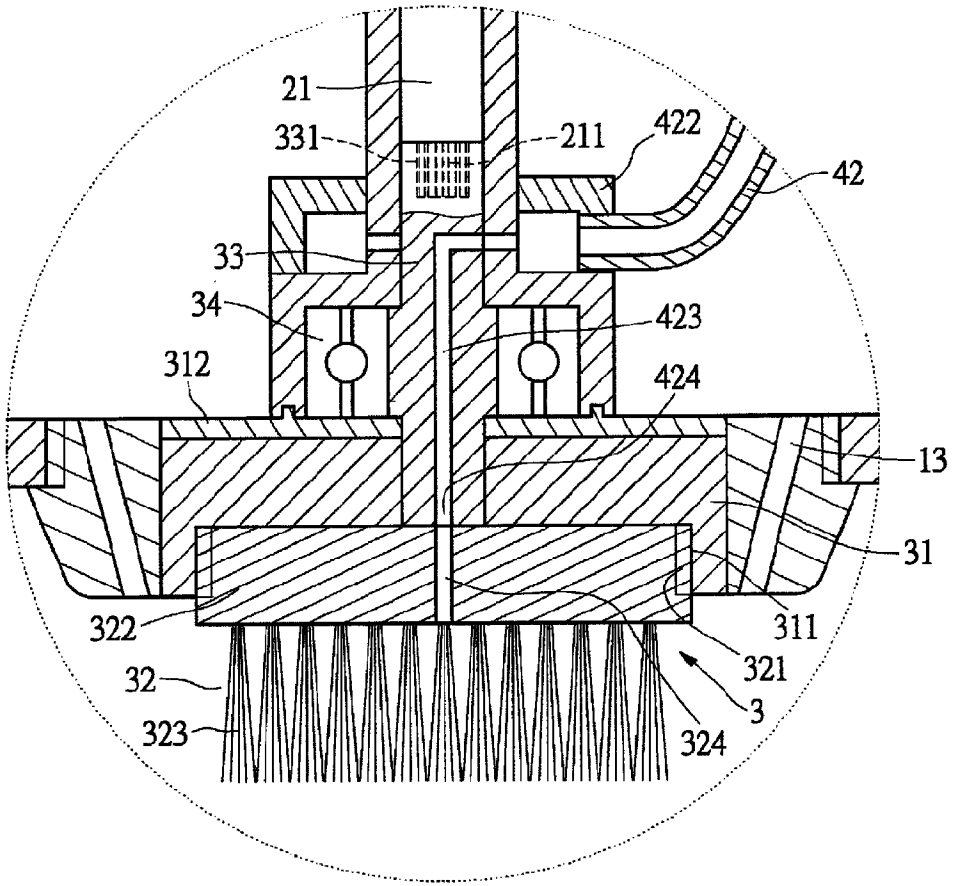
FIG. 9 is a partially enlarged view of a shower head in accordance with a sixth embodiment of the instant disclosure.

Please refer to FIG. 9. In the instant embodiment, the outlet terminal 421 of the duct 42 is connected to a sleeve 422. The sleeve 422 envelops the shaft 33, and the sleeve 422 is in fluid connection with a conduit 423 within the shaft 33. The conduit 423 is in fluid connection with the cleaning portion 32 of the cleaning device, and a conduit outlet 424 is formed where the conduit 423 meets the cleaning portion 32. In this regard, the liquid travels from the tank 41 to the duct 42 and then the sleeve 422. Subsequently, the liquid passes through the conduit outlet 424 to the cleaning portion 32.

Figure 10:
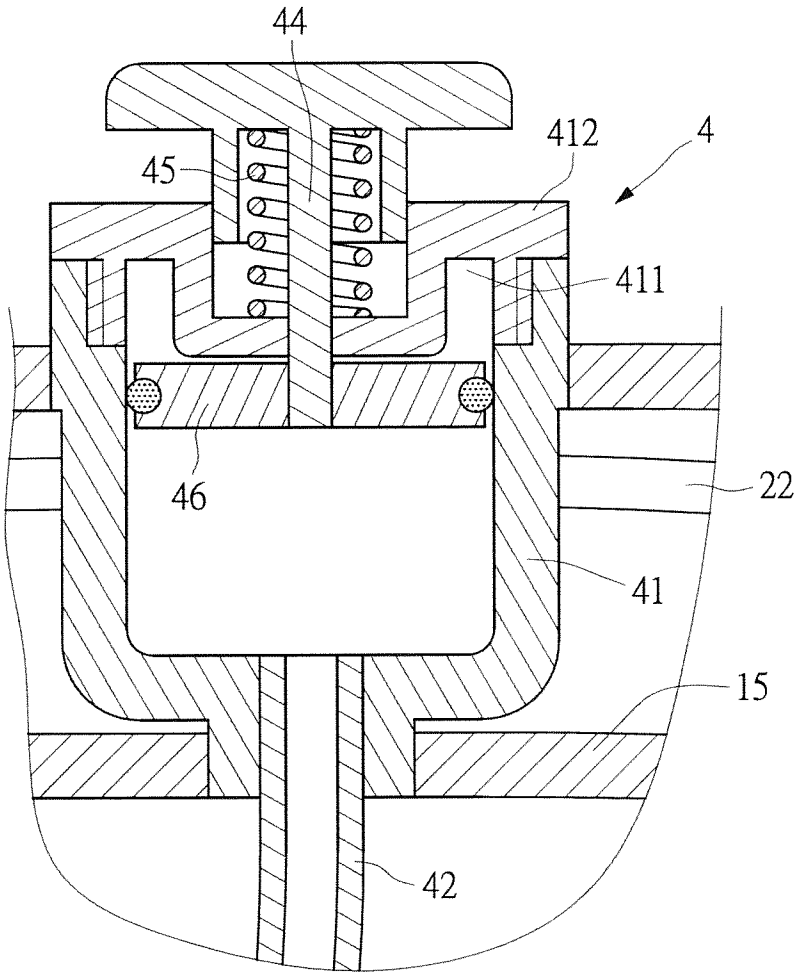
FIG. 10 is a partially enlarged view of a shower head in accordance with a seventh embodiment of the instant disclosure.

Please refer to FIG. 10. In the instant embodiment, the liquid dispenser 4 includes the tank 41 and the duct 42. The tank 41 is disposed in the main body 1 and has portions defining the opening 411. An actuator 44 is disposed on the tank lid 412. One end of the actuator 44 is connected to a valve 46, and the valve 46 is disposed in the tank 41. An elastic member 45 is sandwiched between the tank lid 412 and the actuator 44. The elastic member 45 provides a return force to the actuator after displacement. The actuator 44, elastic member 45 and valve 46 are grouped together as a liquid output mechanism. When the actuator 44 is pressed, the valve 46 displaces and pressures the liquid in the tank 41 toward the duct 42 and further to the cleaning portion 32. However, the liquid output mechanism is not limited to the abovementioned configuration and the instant disclosure is not limited thereto.

Figure 11:
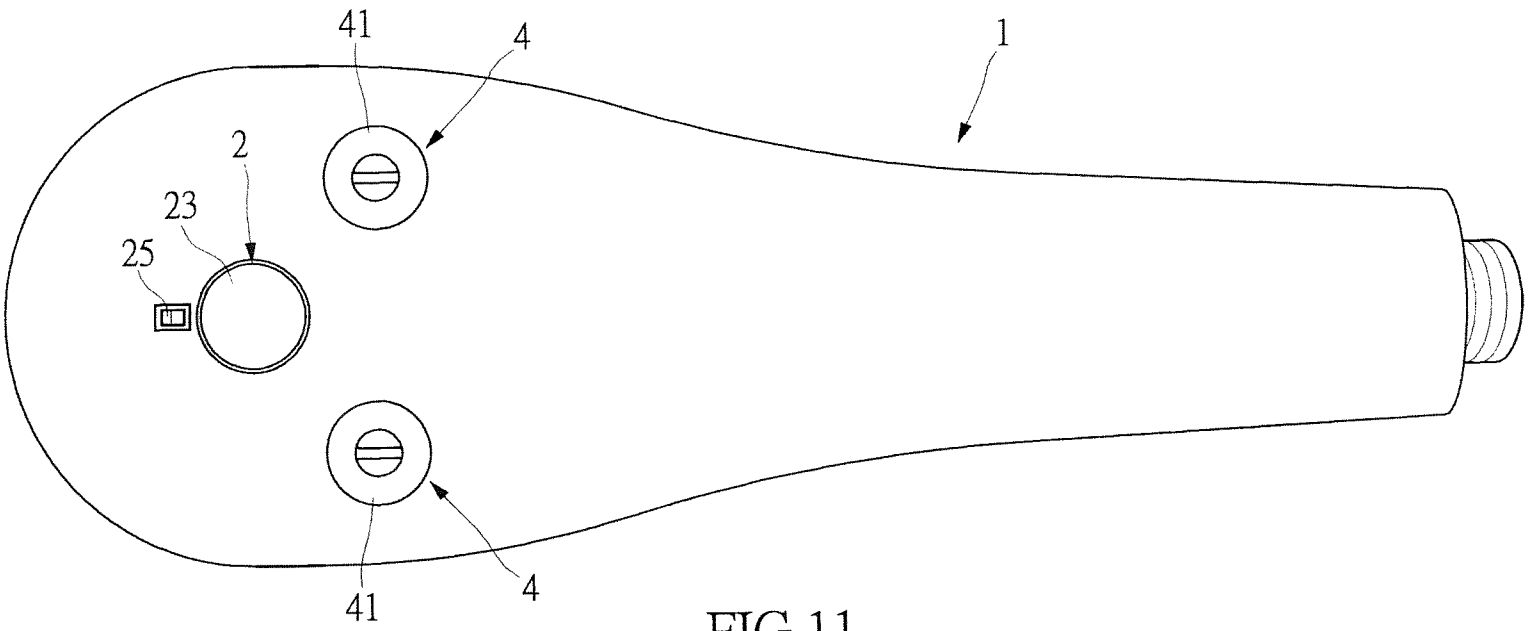
FIG. 11 is a top view of a shower head in accordance with an eighth embodiment of the instant disclosure.

Please refer to FIG. 11. In the instant embodiment, the shower head has two sets of liquid dispensers 4. Two liquid dispensers 4 contain different solutions respectively, such that a user may have more choices available. Of course the shower head may have more than two liquid dispensers 4 disposed in the main body 1. Because the liquid dispensers 4 are detachably secured to the main body 1, the number of liquid dispensers 4 may vary according to specific requirement.

Figure 12:
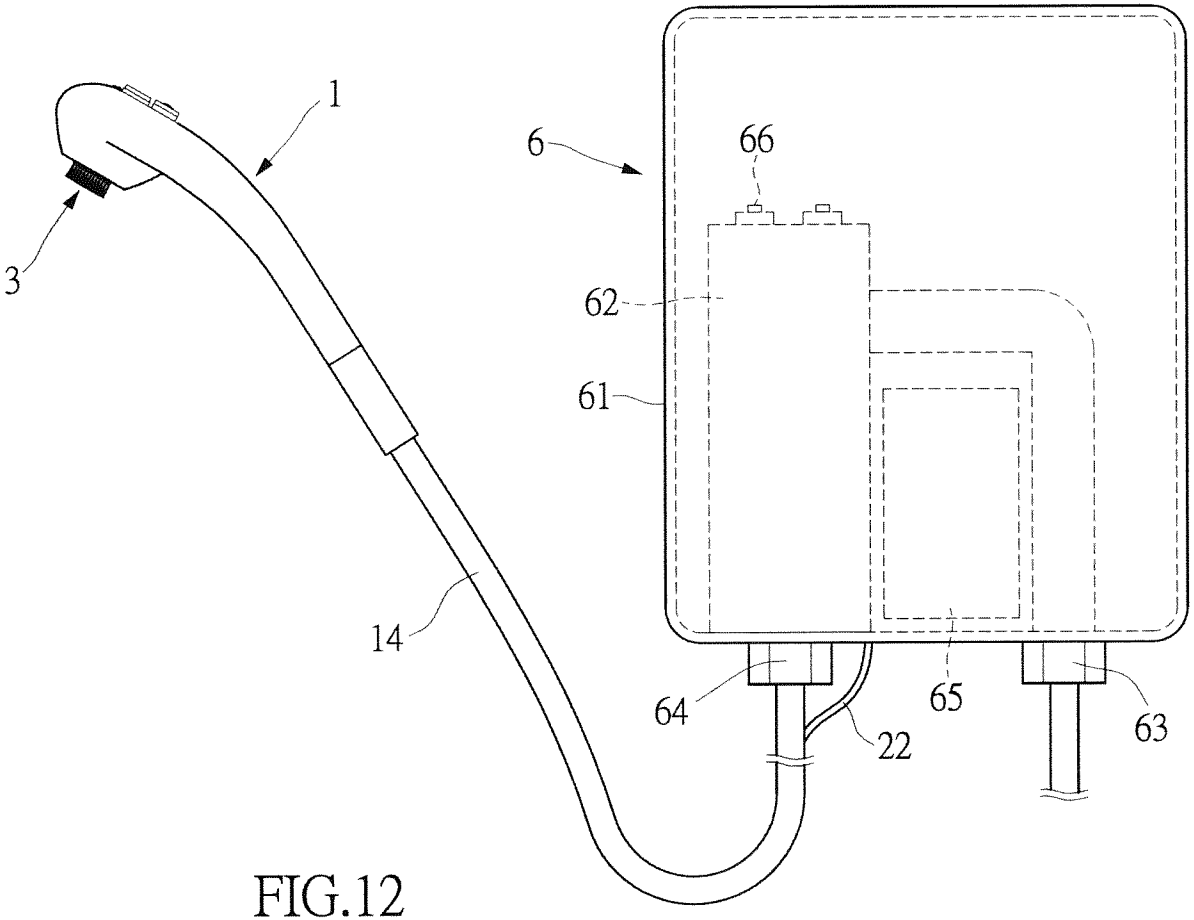
FIG. 12 is a perspective view of a sanitary system in accordance with the instant disclosure.

Please refer to FIG. 12. In the instant embodiment the shower head is combined with an electrical boiler 6 to form a sanitary system. The electrical boiler 6 includes a case 61, a heating tank 62, an inlet end 63, an outlet end 64 and a circuit unit 65. The inlet end 63 and the outlet end 64 are connected to the heating tank 62. The inlet end 63 allows cold water to enter the heating tank 62. The heating tank 62 is disposed within the case 61. An electrical heating component 66 is disposed in the heating tank 62 for boiling the water. Hot water is then output from the outlet end 64. The circuit unit 65 is disposed inside the case 61, and the electrical heating component 66 is electrically connected to the circuit unit 65. The circuit unit 65 regulates the heating process and controls the electrical boiler 6. Furthermore, the electrical boiler 6 may have flow and temperature monitors or the like to display the information of flow and temperature. The electrical boiler 6 is known to a person skilled in the art and therefore the detail description is not elaborated herein.

One end of the hose 14 is connected to the inlet 12 while the other end thereof is connected to the outlet end 64 of the electrical boiler 6. Water is transported from the boiler to the main body 1. One end of the power cable 22 is connected to the motor 2 while the other end thereof is connected to the circuit unit 65 of the electrical boiler 6. Power is then provided to the electrical boiler 6 and passed on to the motor 2 via the cable. In the instant embodiment, the shower head is combined with the electrical boiler 6 so as to provide heated water and electrical power.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A shower head comprising:

a main body having a channel, an inlet and a plurality of outlets, wherein the inlet and the plurality of outlets are fluidly connected by the channel;

a motor disposed in the main body and having a driving shaft;

a cleaning device connected to the shaft of the motor, wherein the cleaning device has a cleaning portion exposed on the main body; and a liquid dispenser, wherein the liquid dispenser is disposed in the main body and has an outlet terminal in fluid connection with the cleaning portion;

wherein the motor is secured in a motor seat, the motor seat has a threaded ring, the main body is formed with a threaded bore for receiving the threaded ring in the main body.

2. The shower head according to claim 1, wherein the cleaning device has a seat and a shaft, the cleaning portion is detachably locked to the seat, one end of the shaft connects to the seat and the other thereof connects to the driving shaft.

3. The shower head according to claim 2, wherein the other end of the shaft is formed with a bore, and the driving shaft has a pillar received by the bore.

4. The shower head according to claim 2, wherein the seat is formed with a first threaded portion, the cleaning portion is formed with a second threaded portion for conforming engagement between the first and second threaded portions.

5. The shower head according to claim 2, wherein the cleaning portion is engaged to the seat by mating, attachment belt or magnets.

6. The shower head according to claim 2, wherein the seat has a lid and is formed with a receiving space and a plurality of apertures at the downstream end thereof, the apertures are in fluid connection with the receiving space, the lid covers the receiving space, and the outlet terminal is in fluid connection with the receiving space.

7. The shower head according to claim 1, wherein the cleaning portion is a brush, a sponge or a scrub sponge.

8. The shower head according to claim 1, wherein the cleaning portion has a plate at the upstream end and a bristle portion at the downstream end, and the plate is formed with a plurality of passages.

9. The shower head according to claim 1, wherein the liquid dispenser has a tank and a duct, one end of the duct is connected to the tank, the other end of the duct is formed with the outlet terminal, the tank has portions defining an opening selectively covered by a tank lid.

10. The shower head according to claim 9, wherein the tank is permanently disposed in the main body or detachably disposed in the main body.

11. The shower head according to claim 1, wherein the liquid dispenser has a switch.

12. The shower head according to claim 1, wherein the motor is connected to a power cable, the interior of the main body is partitioned to formed a power cable channel, the power cable is received by the power cable channel, the inlet is in fluid connection with a hose, the hose and the power cable are integral or separated.

13. The shower head according to claim 1, wherein the outlets are disposed at the circumferential portion of the cleaning portion and slanting toward the center region of the cleaning device.

14. The shower head according to claim 1, wherein the motor is electrically connected to a motor switch and the motor switch is disposed on the main body and exposed thereon.

15. The shower head according to claim 1, wherein the liquid dispenser has a liquid output mechanism.

16. The shower head according to claim 1, wherein the number of liquid dispenser is two or more.

17. A shower head comprising:

a main body having a channel, an inlet and a plurality of outlets, wherein the inlet and the plurality of outlets are fluidly connected by the channel;

a motor disposed in the main body and having a driving shaft;

a cleaning device connected to the shaft of the motor, wherein the cleaning device has a cleaning portion exposed on the main body; and a liquid dispenser, wherein the liquid dispenser is disposed in the main body;

wherein the motor is secured in a motor seat, the motor seat has a threaded ring, the main body is formed with a threaded bore for receiving the threaded ring in the main body.

* * * * *